United States Patent [19]

Hanson

[11] Patent Number: 4,995,376

[45] Date of Patent: Feb. 26, 1991

[54] PULSE FURNACE

[76] Inventor: Garry O. Hanson, 3055 Balsam Ct., Edgewood, Ky. 41017

[21] Appl. No.: 378,656

[22] Filed: Jul. 12, 1989

[51] Int. Cl.[5] ..... F24H 3/02; F23C 11/04

[52] U.S. Cl. ..... 126/110 C; 431/1; 431/12; 431/114; 126/110 R

[58] Field of Search ..... 431/1, 3, 12, 114; 126/110 R, 110 G; 237/2 R, 2 A, 48, 53

[56] References Cited

U.S. PATENT DOCUMENTS

| | | |
|---|---|---|
| 1,702,731 | 2/1929 | Hymer . |
| 2,379,017 | 6/1945 | McCollum . |
| 2,579,047 | 12/1951 | Luty . |
| 2,638,895 | 5/1953 | Swindin . |
| 2,643,708 | 6/1953 | Sherman . |
| 2,898,978 | 8/1959 | Kitchen et al. . |
| 2,916,032 | 12/1959 | Kitchen . |
| 2,929,210 | 3/1960 | Howes . |
| 2,950,592 | 8/1960 | Frank . |
| 2,965,079 | 12/1960 | Collinson . |
| 3,091,224 | 5/1963 | Rydberg . |
| 3,212,556 | 10/1965 | Johansson . |
| 3,267,985 | 8/1966 | Kitchen . |
| 4,120,639 | 10/1978 | Thekdl et al. . |
| 4,164,210 | 8/1979 | Hollowell . |
| 4,241,720 | 12/1980 | Kitchen . |
| 4,241,723 | 12/1980 | Kitchen . |
| 4,260,361 | 4/1981 | Huber . |
| 4,336,791 | 6/1982 | Kitchhen . |
| 4,364,725 | 12/1982 | Buschulte . |
| 4,439,134 | 3/1984 | Olsson . |
| 4,441,879 | 4/1984 | Wagner et al. . |
| 4,457,690 | 7/1984 | Saito et al. . |
| 4,472,132 | 9/1984 | Hisaoka et al. . |
| 4,475,621 | 10/1984 | Cherington et al. . |
| 4,515,145 | 5/1985 | Tallman et al. ..... 126/110 R X |
| 4,542,734 | 9/1985 | Trent et al. . |
| 4,568,264 | 2/1986 | Mullen et al. . |
| 4,634,371 | 1/1987 | Bader . |
| 4,640,674 | 2/1987 | Kitchen . |
| 4,693,082 | 9/1987 | Carlquist . |
| 4,708,635 | 11/1987 | Vishwanath . |

*Primary Examiner*—Larry Jones
*Attorney, Agent, or Firm*—Frost & Jacobs

[57] ABSTRACT

A furnace is provided for combusting liquid or gaseous fuel which has a combustion assembly with an internal cavity that has a mixing chamber and a combustion chamber. A flame tube is disposed intermediate the mixing chamber and the combustion chamber. The combustion assembly has an outlet which is adapted to exhaust the gases which result from combustion of the air-fuel mixture. An ignitor rod for igniting the air fuel mixture is also provided.

26 Claims, 5 Drawing Sheets

PULSE FURNACE

TECHNICAL FIELD

The present invention relates generally to furnaces which utilize combustion assemblies to provide a source of heat to be imparted to ambient air, and is particularly directed to furnaces which are designed for pulse-type combustion, and which may operate on liquid or gaseous fuels. The invention will be specifically disclosed in connection with a furnace which may be adapted to use either liquid fuel or gaseous fuel by utilizing the appropriate fuel nozzle and fuel supply system.

BACKGROUND OF THE INVENTION

Furnaces for use in heating the rooms of residential or commercial buildings are well known. Various types of fuel have been used for furnaces, including natural gas, propane and oil. Equally well known in the art, and recently introduced in the market place, are furnaces known as pulse-type furnaces. Such furnaces burn discrete charges of natural gas or propane, and frequently incorporate features which allow the furnace to operate at above 90% efficiency.

An example of a gas-burning pulse type furnace is disclosed in U.S. Pat. No. 4,568,265, issued to Mullen, et al. Such a furnace includes a combustion chamber into which slightly pressurized natural gas and air at atmospheric pressure are discretely introduced as successive charges resulting in the pulsating delivery of an air-fuel mixture. To start the furnace, air is initially forced into the combustion assembly by activating a purge fan and fuel is delivered by opening the natural gas valve. The first charge of the air-natural gas mixture is ignited by a spark ignitor located in the mixer head. As the first charge combusts, one-way flapper valves on the combustion air supply line and the natural gas supply line close, preventing flow of the exhaust gases thereinto, and forcing the flame front and expanding gases to move upwardly through the combustion chamber and out its exit into the tail pipe assembly. As the expanding gases depart the combustion chamber, a vacuum is formed therein which causes a sequential charge of air and fuel to be drawn into the combustion chamber. Due to the vacuum, this sequential charge does not require the purge fan to force combustion air into the chamber. Due to the heat generated by the combustion of the first charge, the successive charge ignites without the sparking of the ignitor. The furnace continues to operate by such pulsating combustion of successively introduced charges until such time that the fuel supply is turned off.

The outlet of the combustion chamber is connected to a tail pipe, whose length helps determine the frequency of the pulses. The tail pipe is formed in several loops extending from the combustion chamber and joins into an exhaust gas decoupler. From the decoupler, the exhaust gases are directed to a secondary heat exchanger disposed between a blower fan and the combustion chamber.

In order to heat the cold air returned from the living space, the blower fan draws air from the living space and forces the air first through the secondary heat exchanger, which causes the temperature of the exhaust gases flowing therethrough to drop below its dew point temperature. This causes the liquid vapor contained in the exhaust gases to condense, thereby transferring the vapor's latent heat of energy to the room air being heated. At the outlet of the secondary heat exchanger, the exhaust gases are approximately 130° F. or less (i.e. generally below the dew point of the flue gas), and condensed liquid is discharged. After being initially heated by passing through the secondary heat exchanger, the room air to be heated is directed around the tail pipe, the exhaust gas decoupler, the combustion chamber, and the mixer head. The combustion chamber includes fins formed on its exterior surface parallel to the flow of air being heated. In this manner, heat is transferred to the room air from the air-fuel mixture combusting inside of the mixer head-combustion chamber, and from the movement of the flue gases through the tail pipe assembly, exhaust decoupler and secondary heat exchanger. The room air then exits the furnace, and is delivered to the living space being heated.

As mentioned above, in order to constrain the flow of the exhaust gases and flame front to one direction, one-way flapper valves are located on the combustion air supply and the natural gas supply. Additionally, there is an air-intake decoupler and a gas decoupler which are designed to minimize the noise produced by the furnace. The flapper valves are located upstream of the combustion assembly a distance sufficient to minimize the amount of heat transferred thereto. The operation of these flapper valves is well known in the industry.

As identified above, there are numerous sources of fuel which may be used with furnaces. However, there have been problems in developing pulse-type furnaces which operate on oil or other liquid fuels. Heretofore, the gas pulse-type furnace described above could not be modified to operate efficiently with oil or other liquid fuels. The problems encountered resulted from the significant differences between the combustion characteristics of liquid fuels and gaseous fuels. As used herein, gas fuel or gaseous fuels refers to any fuel burned in the gaseous state and not only to natural gas.

In addition to the lack of commercially successful and operational liquid fuel pulse furnaces, there are no pulse furnaces which can burn either liquid or gaseous fuels. There are numerous advantages of such a furnace. For example, a manufacturer would only need to manufacture, stock, and sell one type and size of furnace heat exchanger or heat train, and cabinet, which could be used by customers utilizing gaseous fuel as well as by customers utilizing liquid fuel for any particular range of heat input requirements. Particularly, one size heat exchanger and cabinet could cover a range of heating inputs (e.g. btu/hr. requirements) for both liquid and gaseous fuels, a larger heat exchanger and cabinet for a higher range of heating inputs, etc. Additionally, a customer who wished to switch from liquid fuel to gaseous fuel, or from gaseous fuel to liquid fuel can do so very simply and economically, without having to buy a new furnace. Equally advantageous as the furnace which may run on either gaseous fuel or liquid fuel without modifications is the pulse furnace which can be easily adapted to run on either type of fuel by installing certain minor parts designed for the specific type of fuel to be used, while all of the other components of the furnace remain the same, independent of the type of fuel used. A modular furnace (i.e. one in which the components that vary according to the type of fuel combusted are interchangeable with each other) in which the combustion assembly and heat train components remain the same, while the fuel delivery system is modular is particularly advantageous.

In particular, a major drawback has been the dramatic differences in designs between liquid fuel burning furnaces and gaseous fuel burning furnaces. External to the respective combustion assemblies, it is a relatively simple matter to adapt the fuel delivery system of the furnace to the particular type of fuel selected. However, the prior art combustion assemblies cannot be easily adapted to burn either liquid or gaseous fuels, and none of them can successfully burn liquid fuel in a pulsating combustion manner as described above. Clearly, there is a need for a pulse furnace that is easily and inexpensively adaptable to operate on either liquid fuels or gaseous fuels, depending upon the needs of the buyer. The simpler the adaptation of the furnace, and the greater the commonality of components, the easier and more practical it is for a manufacturer to stock and convert such furnaces, as well as providing corresponding reduced costs to the ultimate consumer and the ability to switch from one fuel to another.

SUMMARY OF THE INVENTION

Accordingly, it is an object of the present invention to overcome the problems and shortcomings of the prior art as set forth above.

It is another object of the present invention to provide a furnace which may be used to efficiently combust liquid fuel.

It is another object of the present invention to provide a furnace which is capable of efficiently combusting liquid fuel in a pulsating manner.

It is yet another object of the present invention to provide a furnace which is capable of combusting liquid fuel or gaseous fuel by interchanging corresponding components which are designed for the specific type of fuel the furnace is to burn.

It is another object of the present invention to provide a furnace which can burn either liquid fuel or gas fuel that minimizes the number of different components necessary to allow the furnace to operate with the particular type of fuel selected.

It is yet another object to provide a furnace which can burn either liquid fuel or gaseous fuel in dependence upon the fuel delivery system incorporated in the furnace.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a furnace is provided which has a combustion assembly with an internal cavity that has a mixing chamber and a combustion chamber. A flame tube is disposed intermediate the mixing chamber and the combustion chamber. The combustion assembly has an outlet which is adapted to exhaust the gases which result from combustion of the air-fuel mixture. Means for igniting the air fuel mixture is also provided.

In accordance to a further aspect of the present invention, means are provided for interchangeably connecting a fuel dispensing tube in a position to discharge fuel into the mixing chamber.

In accordance to yet another aspect of the present invention, a combustion air-supply tube is connected to the inlet of the mixer chamber and adapted to supply a flow of combustion air. The fuel dispensing tube is disposed at least partially in the combustion air supply tube.

In a further aspect of the present invention, an aperture is formed through the wall of the combustion air-supply tube, and the connecting means comprises a fuel manifold which is in fluid communication with the fuel dispensing tube and defining a fuel flow path thereby, with the fuel flow path being located through the aperture.

According to another aspect of the present invention, the mixer chamber has a rectangular cross-section.

In yet a further aspect of the present invention, the combustion chamber has a circular cross section.

According to a yet further aspect of the present invention, the combustion chamber has inwardly converging walls which form a frustaconical surface.

In still another aspect of the present invention, means are provided associated with the combustion chamber for detecting the presence of combustion therein.

In still another aspect of the present invention, a combustion chamber for the pulsating combustion of an air-liquid fuel mixture includes a liquid fuel dispensing tube which is connectable to a source of liquid fuel, and a liquid fuel nozzle carried by the dispensing tube which is oriented to discharge liquid fuel into the mixer chamber.

In accordance to another aspect of the present invention, the flow of liquid fuel from the liquid fuel nozzle does not directly impinge mixing chamber side walls.

In still a further aspect of the present invention, a portion of the liquid fuel dispensing tube is disposed substantially parallel to the air flow within the combustion air supply tube.

In yet a further aspect of the present invention, a combustion chamber is provided for the pulsating combustion of an air-gas fuel mixture, which includes a gas fuel dispensing tube which is connectable to a source of gas fuel, and a gas fuel nozzle which is carried by the dispensing tube and oriented to discharge gas fuel into the mixer chamber.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of this specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
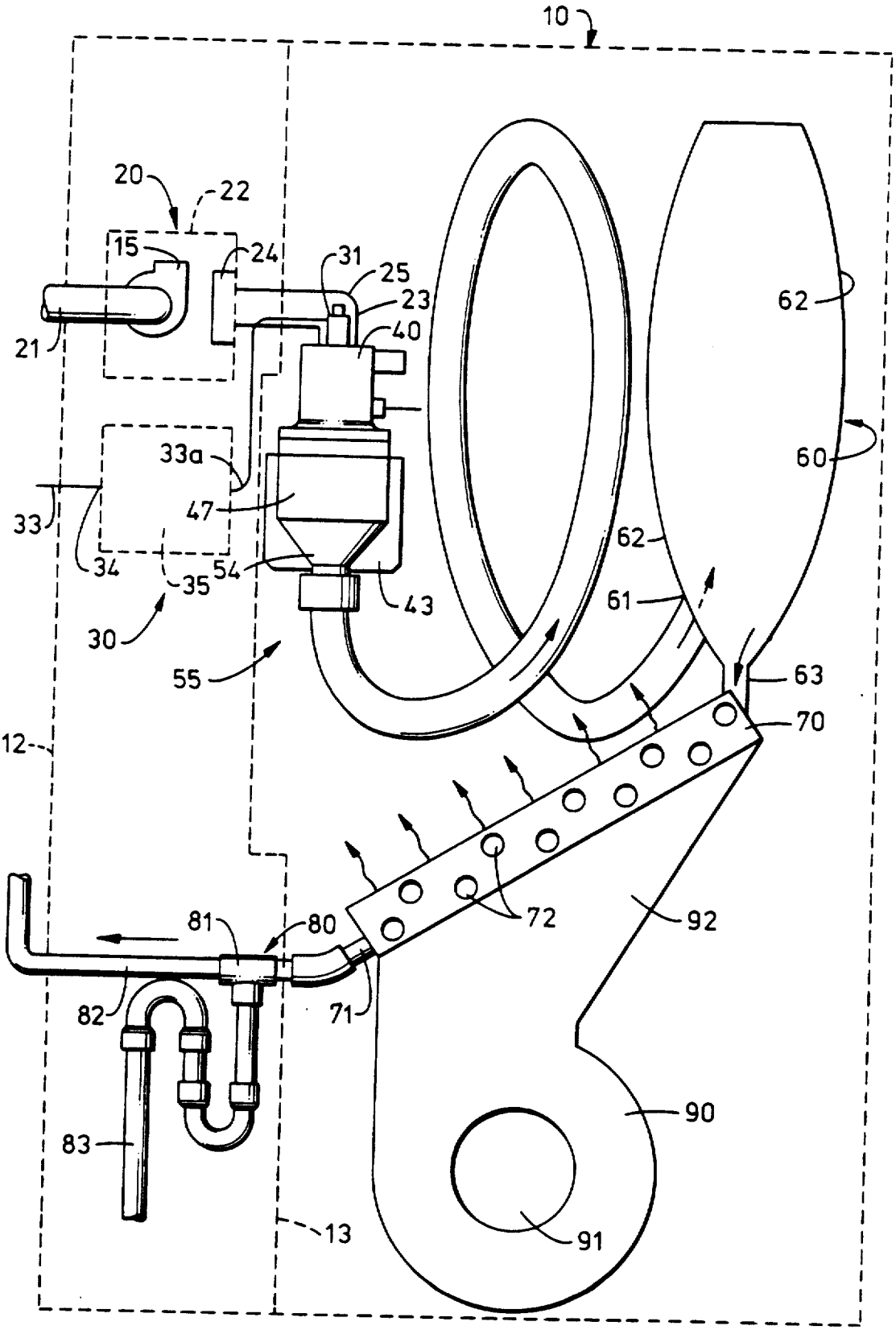
FIG. 1 is a schematic drawing of the environment in which the combustion chamber is used.

Referring now to the drawings in detail, wherein like numerals indicate the same elements throughout the views, FIG. 1 schematically shows a pulse furnace, generally designated as 10. Within the cabinet 12 of the furnace, schematically indicated by the dashed outline is located a combustion air delivery system 20, a fuel delivery system 30, a mixer head or mixing chamber 40, an expansion or combustion chamber 47, a tail pipe assembly 55, an exhaust decoupler 60, a secondary heat exchanger 70, vent 80, and a blower fan 90. It should be noted that mixer head 40 and combustion chamber 47 can be referred to jointly as the combustion assembly.

Combustion air delivery system 20 includes air inlet tube 21 which originates outside of cabinet 12 and communicates with the interior of air decoupler 22 through purge fan 15. Air inlet tube 21 provides for fluid communication between the ambient atmosphere and air decoupler 22, which in turn communicates with mixing chamber 40 via combustion air supply tube 23. Air decoupler 22 serves to attenuate the noise generated by the combustion of the air-fuel mixture within mixing chamber 40 and combustion chamber 47. Air flapper valve 24 is disposed within air decoupler 22 and provides a communicating link between air decoupler 22 and combustion air supply tube 23. Air flapper valves such as contemplated by valve 24 are well known in the art, and are pressure actuated to allow air to flow in only one direction, e.g., from the interior of air decoupler 22 to the combustion air supply tube 23.

As will be understood, air flapper valve 24 automatically closes when combustion within chamber 47 occurs, generating a wave of relatively higher pressure than the pressure within air decoupler 22. The exhaust gases or flue gases flow out of combustion chamber 47 through tail pipe assembly 55.

Figure 4:
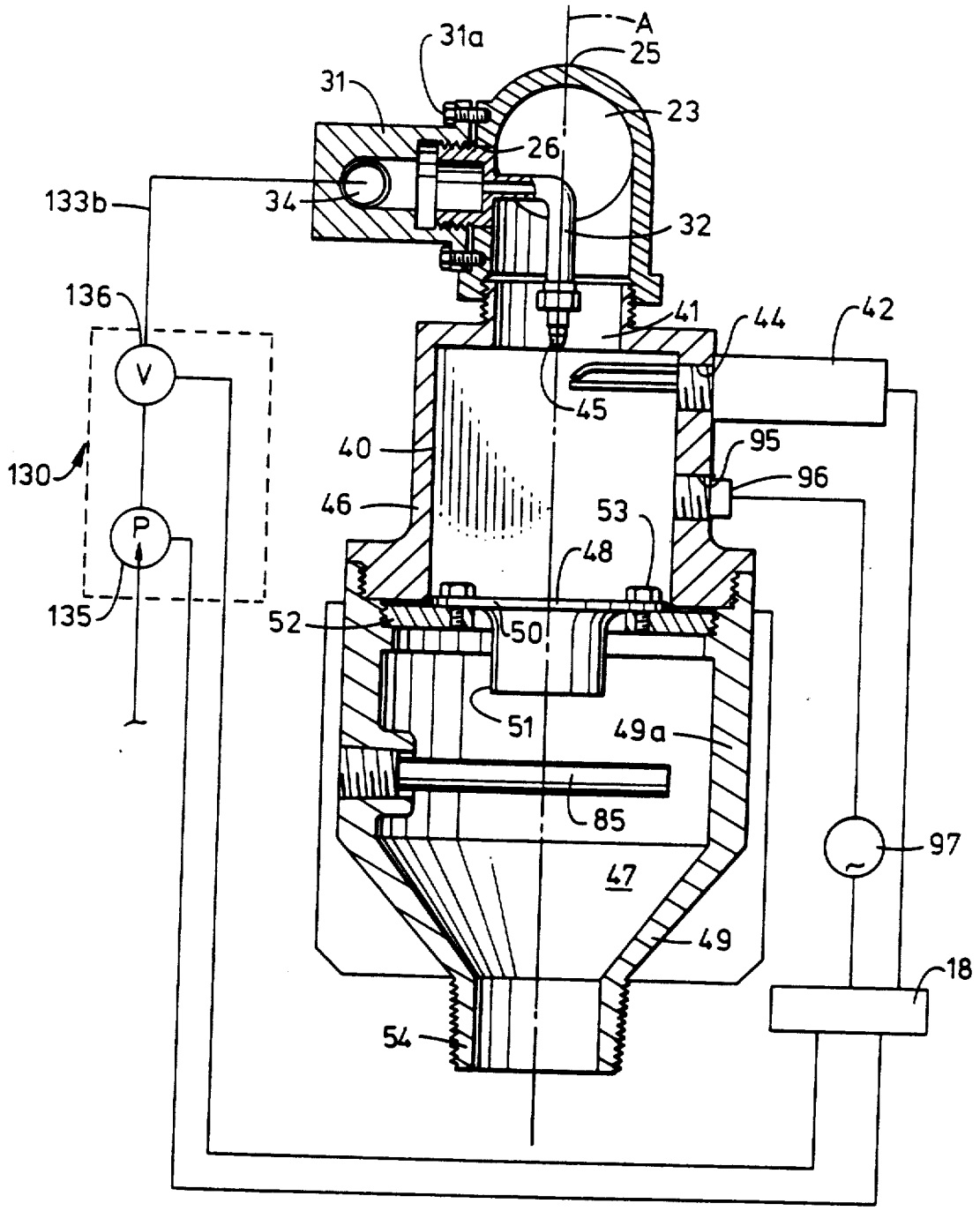
FIG. 4 is a partial cross-sectional view of the furnace combustion assembly of the preferred embodiment adapted to combust liquid fuel.

As best seen in FIG. 4, combustion air supply tube 23 has elbow 25 which is connected to inlet 41 of mixer head 40. As is well known in the industry, elbow 25 is commonly used to reduce the overall height of furnace 10, although combustion air supply tube 23 functions the same whether it is completely straight or has an elbow.

Returning to FIG. 1, mounted to the combustion air supply tube 23 is fuel manifold 31 which carries a fuel-dispensing tube 32 (shown in FIG. 4) disposed in the interior of combustion air supply tube 23 near the inlet 41. A fuel supply line 33*a* delivers fuel from the fuel delivery system 30 to the fuel manifold 31. Fuel manifold 31 is in fluid communication with fuel-dispensing tube 32.

Outlet 54 of combustion chamber 47 is connected to tail pipe assembly 55. Tail pipe assembly 55 is comprised of a series of loops formed in a length of pipe which terminates at and communicates with exhaust decoupler inlet 61. The pulse frequency of the combustion is partially dependent upon the length of tail pipe assembly 55, according to Helmholz's law. Helmholz's law is well known in the industry and will not be further discussed herein. The length of tail pipe assembly 55 is selected in light of the other Helmholz law variables (e.g. diameter, volume and speed of sound) to produce the desired design pulse frequency.

Exhaust decoupler 60 receives exhaust gases flowing out of tail pipe assembly 55, and serves to attenuate the sound created by the pressure waves that result from combustion, as mentioned above. Outer walls 62 of exhaust decoupler 60 also transfer heat to the room air being heated by furnace 10 as will be further described below.

Exhaust decoupler outlet 63 is connected to the inlet of secondary heat exchanger 70, and delivers the exhaust gases thereto. Secondary heat exchanger 70 is typically a finned-tube heat exchanger which is disposed over outlet 92 of blower fan 90. Secondary heat exchanger 70 has an outlet 71 which is connected to exhaust vent 80, and directs the exhaust gases and fluids thereto. Exhaust vent 80 includes T-shaped element 81 which operates to separate water and other condensed liquid by-products of combustion from the exhaust gases. Exhaust gases are vented from furnace 10 via exhaust tube 82, while liquid condensate is expelled via drain 83. Exhaust tube 82 can preferably be located closely adjacent air inlet tube 31 to minimize the number of openings required in cabinet 12 and to provide some preheating of combustion air before the air is delivered to mixing chamber 40 thereby increasing efficiency.

Secondary heat exchanger 70 is designed to lower the temperature of the exhaust gases flowing therethrough below the effective dew point temperature of the gases in order to condense the liquid by-products of combustion, thereby releasing the latent heat held therewithin. Liquid exhaust or drain 83 and exhaust vent 82 extend beyond furnace cabinet 12, to expel the exhaust gases remotely.

In operation, when conditions call for heat, purge fan 15 is activated, and fan 15 operates to deliver fresh air to the interior of mixer head 40 for the initial pulse combustion. Purge fan 15 also slightly pressurizes the interior of mixing chamber 40. Fuel is then delivered to fuel manifold 31, and through fuel dispensing tube 32 to mix with the combustion air flowing into the interior of mixer head 40. The initial charge of the air-fuel mixture impacts ignitor 42 and is intermixed thereby. The air-fuel mixture is ignited by ignitor 42, causing an explosion which results in heat and the concomitant expansion of gases. This pulse combustion creates a pressure wave which expands in all directions. The expansion results in slight pressurization of combustion air-supply tube 23, thereby closing air flapper valve 24 and preventing any reverse air flow therethrough. Constrained to flow in the opposite direction, the expanding and combusting gases exit mixing chamber 40, pass into the combustion chamber 47 where combustion continues, and flows through tail pipe assembly 55. Heat is generated by combustion within the mixer head-combustion chamber, and is transferred to mixer head 40 and combustion chamber 47, as well as tail pipe assembly 55, exhaust decoupler 60 and secondary heat exchanger 70 by the combustion and flow of exhaust gases.

The exiting of the exhaust or flue gases from combustion chamber 47 results in a slight vacuum being formed within mixing head 40 and combustion chamber 47. This vacuum draws the next charge of air into mixing chamber 40 by automatically opening flapper valve 24, where it, along with the fuel, spontaneously ignites due to the heat of mixing chamber 40. As is well known, after the initial pulse combustion, the pulse system becomes self-propagating or self-sustaining, and purge fan 15 and ignitor 42 no longer need to be operated, being used only to start the system.

Exhaust gases flow through tail pipe assembly 55 and into the interior of exhaust decoupler 60, which provides a large volume for the gases to expand within. The exhaust gases exit through exhaust decoupler outlet 63 and into the secondary heat exchanger 70, flowing through the arrangement of tubes 72 comprising heat exchanger 70. As mentioned above, the temperature of the exhaust gas is lowered below its dew point temperature, in order to produce condensation of the by-products of combustion. Following condensation, exhaust gases and exhaust liquids flow out of secondary heat exchanger outlet 71 into exhaust vent 82 and liquid exhaust or drain 83. At outlet 71, the exhaust gases typically have a temperature in the range of 90° F. to 130° F.

It should noted that the exhaust gases at outlet 71 can have a temperature in the range of between about room or ambient temperature and theoretical dew point of the exhaust gas for a given application. The closer the exhaust gas temperature is to ambient or room temperature, the higher the overall efficiency of the pulse furnace. This is true because the maximum amount of moisture will be condensed when the exhaust gases are at ambient temperature, and the furnace will accordingly extract a higher amount of latent heat of energy from the water produced in the combustion process.

The above description relates to how the air and fuel mixture is pulse combusted and routed through furnace 10. It should be noted that the combustion system can be completely isolated from air within a space to be heated by drawing air from outside the space through air inlet tube 21 and exhausting through exhaust vent 82.

The heat train (mixing chamber 40, combustion chamber 47, tail pipe assembly 55, exhaust decoupler 60 and secondary heat exchanger 70) are separated from other components of furnace 10 by vestibule panel 13, which also confines the air to be heated. To heat the room air, blower fan 90 draws ambient air from the space to be heated through its inlet 91 (which is typically filtered) and forces it out its outlet 92 directly across the finned tubes of the secondary heat exchanger 70. The temperature of the air is increased by absorbing heat from the exhaust gases flowing through heat exchanger 70, and the fins of the tubes 72 serve to increase the surface area to augment heat exchange with the room air. The room air then flows past the exterior surfaces of mixing chamber 40, combustion chamber 47, tail pipe assembly 55 and exhaust decoupler 60. Heat transfer fins 43 are externally disposed about combustion chamber 47, generally parallel to the direction of flow of the room air. As the air flows across these components, heat is transferred to the air, correspondingly reducing the temperature of the exhaust gases within those components. The air exits furnace 10 and is directed by appropriate ducting to the space being heated.

As is well known in the art, the actual direction of air flow may be upward, as shown, downward or horizontal across the secondary heat exchanger and past the other furnace components. For efficiency, the air flow first flows across secondary heat exchanger 70 before being directed across mixer head 40, combustion chamber 47, tail pipe assembly 55 and exhaust decoupler 60. Secondary heat exchanger 70 may be omitted if desired to economize on unit cost, however such reduction is not without significant reduction of the overall efficiency of furnace 10 by approximately 10% to 12%. The same standardization of components between gaseous and liquid fuel versions still exists as with the presence of the secondary heat exchanger, but provides the advantage of offering the consumer less cost, but at reduced efficiency. This could be the system of choice for economy in milder climate heating zones.

Figure 2:
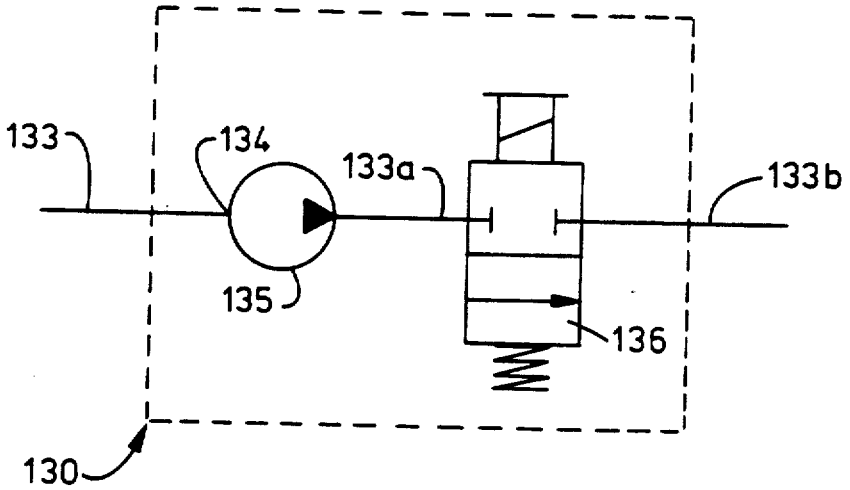
FIG. 2 is a schematic drawing of a liquid fuel delivery system.
Figure 3:
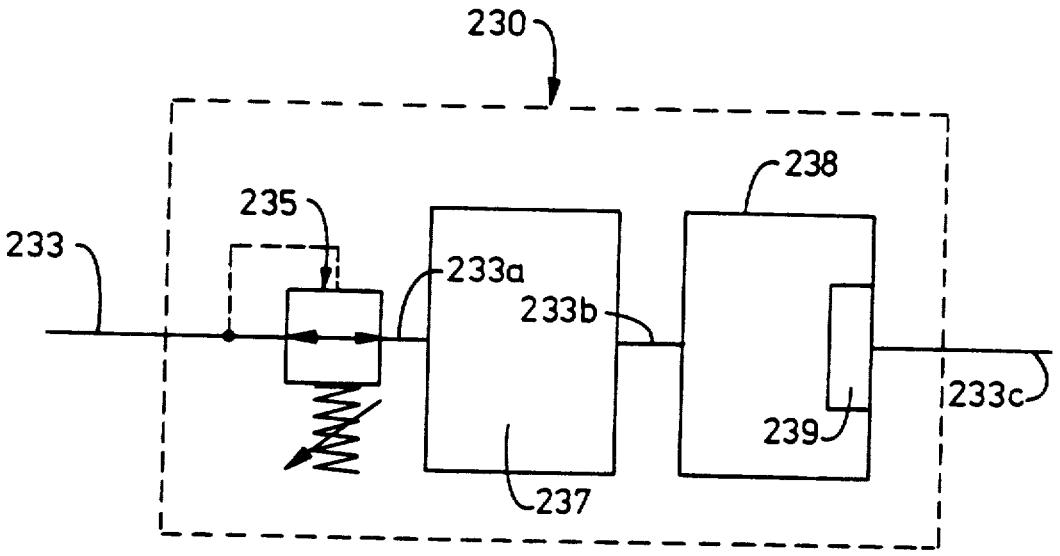
FIG. 3 is a schematic drawing of a gas fuel delivery system.

The preferred embodiment of the present invention is capable of operating either with a liquid fuel, such as oil, or a gaseous fuel, such as natural gas. FIGS. 2 and 3 schematically detail the fuel delivery system 30 as adapted for liquid or gaseous fuels. FIG. 2 shows a liquid fuel delivery system 130 having a liquid fuel supply line 133 connected to the inlet 134 of liquid fuel pump 135. Fuel pump 135 is connected by intermediate liquid fuel line **133*a* to a solenoid-operated valve 136. Valve 136 is connected to fuel manifold 31 by liquid fuel supply line 133*b*. Liquid fuel pump 135 operates continuously to provide a flow through the liquid fuel supply line 133*a* to fuel manifold 31. If it becomes necessary to interrupt the flow of liquid fluid, solenoid valve 136 is closed, rather than stopping the liquid fuel pump 135, as solenoid valve 136 can terminate the flow of liquid fluid into the manifold 31 much faster than if the liquid fuel pump 135** is deactivated.

FIG. 3 schematically details the gaseous fuel delivery system 230. The gaseous fuel supply line 233 delivers gaseous fuel to the gas valve 235 at a pressure of about 7 inches of water column (W.C.). A gas regulator in valve 235 regulates the gas pressure to approximately 2–5 inches water column (W.C.), and delivers the gaseous fuel through intermediate gas fuel line **233*a* to gas decoupler 237, which performs a function similar to air decoupler 22 as described above. Within union adapter 238 disposed between gaseous fuel supply lines 233*b* and 233*c*, gas flapper valve 239 is disposed, which delivers the gaseous fuel through gaseous fuel supply line 233*c* and thereafter to fuel manifold 231. Gas flapper valve 239 is well known and operates in a manner similar to the air flapper valve 24** described above in response to varying pressures within the system to prevent the reversal of the direction of flow of the gas fuel and to enable the intermittent inflow of gaseous fuel in a pulsing manner.

FIG. 4 shows mixer head 40 and combustion chamber 47 of the present invention in cross-section. The internal cavity defined by mixer head 40 is in fluid communication with inlet 41 and outlet 54. The internal cavity provides a mixing chamber for the fuel and the air to be combusted. The internal cavity is connected to combustion chamber 47 via flame tube 48. In particular, mixing chamber 40 communicates with the combustion chamber 47 through flame tube 48. Air is provided to the internal cavity of mixing chamber 40 via inlet 41 for mixing with liquid fuel injected via liquid fuel nozzle 45. As shown, a central cavity axis A is preferably defined along the centers of inlet 41 and outlet 54. In most applications, axis A will preferably be substantially vertical in orientation.

The combustion portion of this device is shown as comprising an upper mixing chamber housing 46 and a lower expansion chamber or combustion chamber housing 49. The mixing chamber housing 46 is detachably secured to the expansion chamber housing 49 by an appropriate threaded or similar compression type connection. Flame tube 48 is illustrated as comprising a flange portion 50 and a hollow tube portion 51 depending from the flange 50. Hollow tube portion 51 has a longitudinal axis preferably generally aligned with the central cavity axis A. The flange portion 50 is secured to a flame tube holder 52 such as by threaded fasteners 53. Flame tube holder 52 is preferably a circular plate which has a centrally disposed aperture through which hollow tube portion 51 extends into combustion chamber 47. Flame tube holder 52 is detachably secured to expansion chamber housing 49 such as by a threaded arrangement as illustrated.

Flame tube 48 augments the vaporization of the air-liquid fuel mixture and increases the turbulence to optimize combustion. The interior diameter of hollow tube portion 51 is selected to determine effectivity and control the flow of combustion air into mixer head 40 and combustion chamber 47.

The mixing chamber 40 is defined by the mixing chamber housing 46, the flame tube 48 and holder 52. Attached to inlet 41 of mixer head 40 is combustion air-supply tube 23, which can be threadedly mounted to the upper portion of mixing chamber 40. Aperture 26 is formed through combustion air supply tube 23 immediately above the mixing chamber 40. Fuel manifold 31 is secured in sealing engagement to the exterior of air supply tube 23 by threaded fasteners **31*a*, and carries liquid fuel dispensing tube 32 which is detachably secured thereto such as by a threaded connection as shown. The portion of liquid fuel dispensing tube 32 between the 90-degree elbow and nozzle 45 is shown as being disposed substantially parallel to and concentrically mounted within combustion air supply tube 23 immediately above inlet 41. This allows the air flow through the interior of combustion air supply tube 23 to cool nozzle 45 and liquid fuel dispensing tube 32** during operation.

Liquid fuel supply line **133*b* is connected to the inlet port 34. A fuel flow path is defined from inlet port 34 through liquid fuel dispensing tube 32 and liquid fuel nozzle 45. This liquid fuel flow path is located through aperture 26**.

Figure 6:
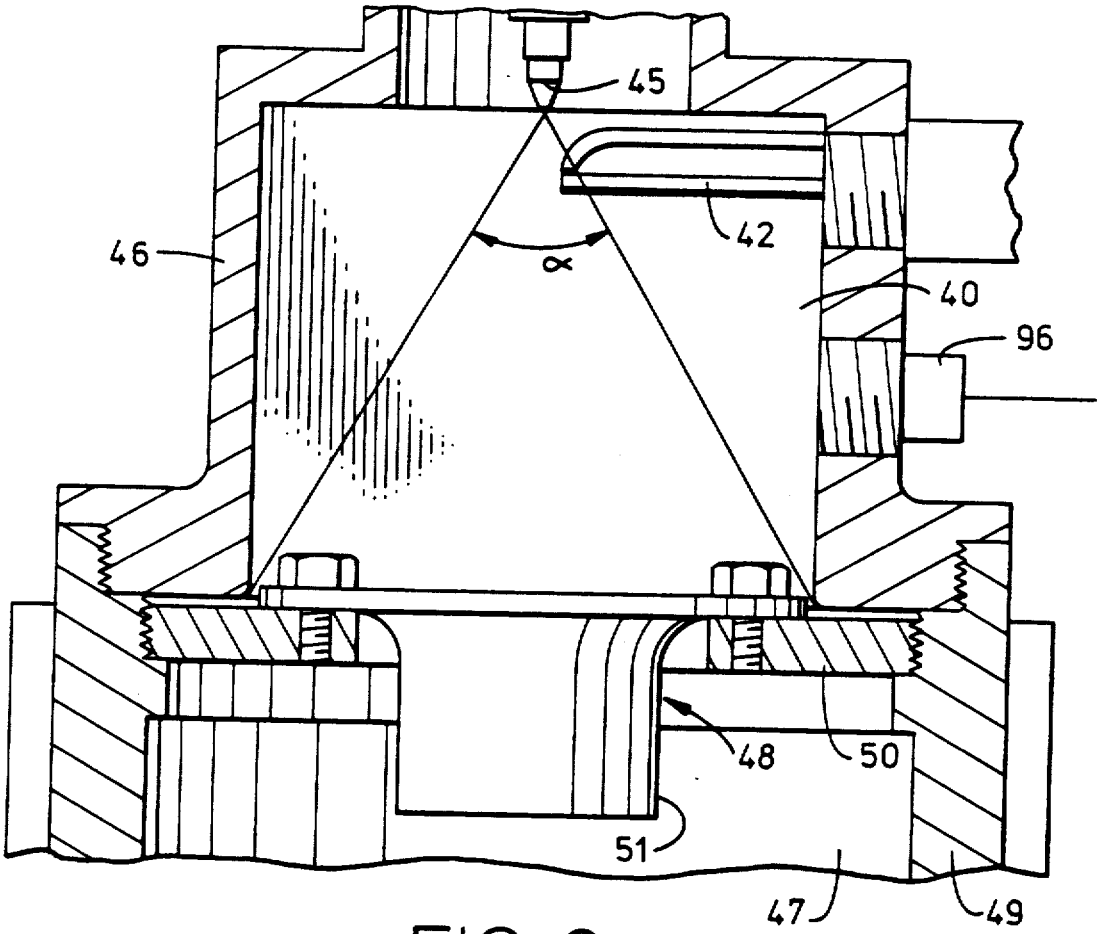
FIG. 6 is an enlarged fragmentary view of the furnace combustion assembly of the preferred embodiment showing the spray pattern of the liquid fuel nozzle.

Liquid fuel nozzle 45 sprays and atomizes liquid fuel flowing therethrough into mixing chamber 40. As shown in FIG. 6, the included angle alpha ($\alpha$) of spray nozzle 45 is oriented such that the flow of liquid fuel therefrom does not directly impinge the inner walls of mixing chamber 40. FIG. 6 shows the liquid fuel flow pattern in the free state, absent any combustion or deflection by the ignitor 42, which extends into the spray pattern. While atomized fuel may indirectly contact the walls of mixing chamber 40 as a result of combustion or rebound off of flame tube 48 or holder 52, it is important that nozzle 45 be oriented such that no direct impingement of liquid fuel on the walls of mixing chamber 40 occurs which would tend to quench the combustion process and reduce the efficiency of the combustion therein.

Liquid fuel nozzle 45 is preferably detachably secured to liquid fuel dispensing tube 32. For a given size of mixer head 40, the input capacity of the overall system may be adjusted by changing liquid fuel nozzle 45 and flame tube 48 (i.e. increase the flow rate of nozzle 45 and the inner diameter of flame tube 48). To downsize the input capacity of furnace 10, a liquid fuel nozzle 45 with a smaller orifice (i.e. flow rate), and a flame tube 48 with a smaller inner diameter can be used.

Mixing chamber 40 has ignitor plug 42 disposed therein, such as by threaded engagement with a threaded hole 44. Ignitor 42 extends partially into the flow path of the liquid fuel, and, as described below, provides ignition of the first charge of the air-fuel mixture. A second threaded hole 95 is illustrated for mounting pressure tap 96 which is connected to pressure switch 97. Tap 96 and switch 97 serve to monitor the increase in pressure within mixing chamber 40 upon combustion, thereby indicating the presence of combustion and the proper operation of furnace 10. Pressure switch 97 is electrically connected to controller 18, which allows continued operation of mixing chamber 40 and combustion chamber 47 so long as combustion is indicated by pressure switch 97. If combustion fails to occur, the controller will subsequently close solenoid valve 136, shutting off the fuel flow through to the mixing chamber and combustion chamber.

Combustion chamber 47 has a circular cross-section, and is defined by the walls of housing 49. A portion **49*a* of walls 49 are shown as being substantially parallel prior to converging inwardly in a substantially frustroconical manner along the lower portion of chamber 47 leading to outlet 54. This particular geometry of combustion chamber 47 is preferred to provide greater stability of flow in the system, but it is not critical to the operation of furnace 10**. For example, the chamber equally could be cylindrical with parallel walls throughout its length.

Ignitor rod 85 is shown disposed in the path of exhaust gases which flow from hollow tube portion 51 of flame tube 48 into combustion chamber 47. Ignitor rod 85 is preferably detachably mounted such as by threaded engagement with a threaded aperture extending through a portion of expansion chamber housing 49, as illustrated. Ignitor rod 85 is illustrated as having a generally circular cross-section, and promotes inter-mixing of the exhaust gases which flow into the expansion chamber 47. The exhaust gases heat ignitor rod 85, and unburned fuel which flows from mixing chamber 40 into expansion chamber 47 can be ignited by the ignitor rod 85 due to its elevated temperature. The inter-mixing promoted by the ignitor rod 85, and subsequent ignition of unburned fuel located in expansion chamber 47 provides more complete combustion of the air-fuel mixture, yielding a higher efficiency of the mixer head-combustion chamber apparatus. Ignitor rod 85 may be made of any suitable material, such as a high nickel-chromium alloy or its equivalent.

Mixing chamber 40 and combustion chamber 47 are shown in FIG. 4 as they would be preferably oriented for operation. To start the combustion process air flows from purge fan 15 through combustion air supply tube 23. After a short period of pumping clean air through the system, pump 135 is energized and valve 136 is opened, delivering liquid fuel to the fuel manifold 331, which results in the spray of atomized liquid fuel into mixing chamber 40. Ignitor 42 is energized to combust the air-fuel mixture within mixing chamber 40. Upon combustion, the pressure increases in mixing chamber 40, as well as in combustion air supply tube 23, thereby closing air flapper valve 24. This effectively forces the exhaust gases to flow out of mixing chamber 40 through hollow tube portion 51 of flame tube 48 into combustion chamber 47 where the hot gases continue to expand and are inter-mixed by ignitor rod 85. These exhaust gases continue down the frustroconical lower portion of chamber 47 through the combustion chamber outlet 54.

The exiting exhaust gases effectively create a negative pressure within mixing chamber 40, causing air flapper valve 24 to open thereby delivering another charge of combustion air to mixing chamber 40. Liquid nozzle 45 continuously sprays liquid fuel into mixing chamber 40 during this time, As the new charge of combustion air enters mixing chamber 40, combustion occurs without the operation of ignitor 42 due to the heat of the previous combustion. The subsequent charge of air and fuel burns and flows in the same manner as described above. When ignitor rod 85 is heated to a sufficient temperature by the exhaust gases, it will also tend to ignite unburned fuel flowing through combustion chamber 47.

Figure 5:
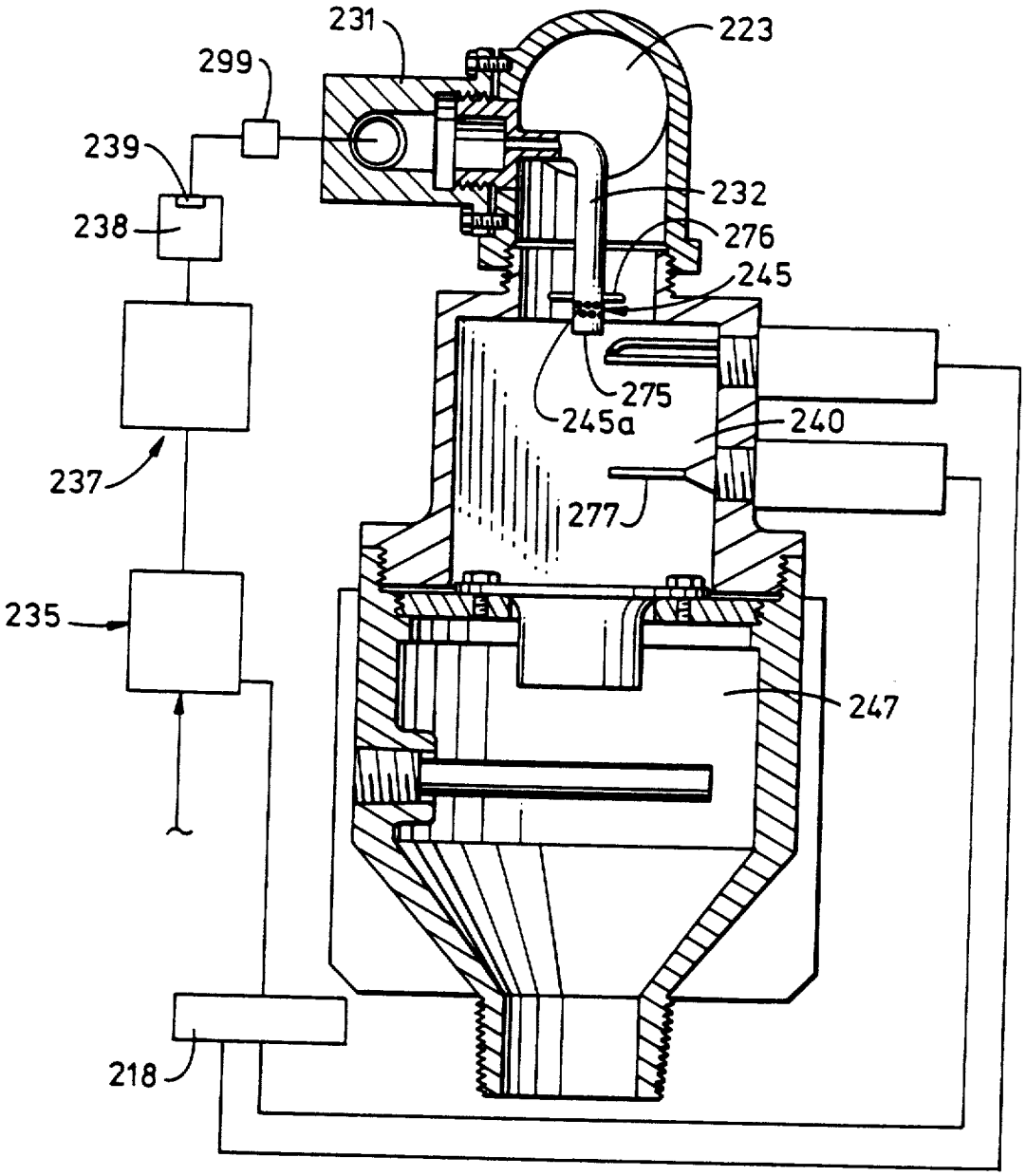
FIG. 5 is a partial cross-sectional view of the furnace combustion assembly of the preferred embodiment adapted to combust gas fuel.

As just described, the mixing chamber-combustion chamber arrangement of the invention (e.g. FIG. 4) allows the pulse combustion of a liquid fuel. The present invention, however, also provides for the pulse combustion of gaseous fuel, by simply replacing the liquid fuel dispensing tube 32 and liquid fuel nozzle 45 with an interchangeable gaseous fuel dispensing tube 232 which carries gaseous fuel nozzle 245. As can be seen in FIG. 5, the gaseous fuel dispensing tube 232 is received and held by the fuel manifold 231 in the same manner as the liquid fuel dispensing tube 32. Gaseous fuel dispensing tube 232 includes a closed end 275 and an annular disk 276 spaced upwardly from the closed end 275. Disposed between the annular disk 276 and the closed end 275 are a plurality of gaseous fuel orifices 245*a* comprising gaseous fuel nozzle 245, which discharges gaseous fuel flowing through gaseous fuel dispensing tube 232 into the air flowing through combustion air supply tube 223 and into mixing chamber 240. The velocity of the gaseous fuel exiting nozzle 245 may be controlled by the size of orifices 245*a*, while the flow rate of the gaseous fuel may be controlled by orifice 299. As can be seen, the gas fuel is discharged from gas nozzle 245 at a right angle to the flow of combustion air, radially outward from gas nozzle 245 as a result of closed lower end 275. This promotes thorough mixing and impingement of the gaseous fuel with the combustion air. The mixer head 240 and combustion chamber 247 arrangement operates with an air-gaseous fuel mixture in the same manner as described above with respect to the air-liquid fuel mixture, with the exception that the gaseous fuel does not flow continuously from gas nozzle 245. In particular, the gaseous fuel flows as discrete charges caused by the combination of combustion within mixing head 240 and gas flapper valve 239 illustrated within union adapter 238.

Also shown in FIG. 5, is flame monitoring rod 277 for detecting the presence of combustion (i.e. a flame) in mixing chamber 240. Flame monitoring rod 277 cannot easily be used with liquid fuel because of deposits which would form thereon which would inhibit the sensing of a flame. However, with gas fuels, flame monitoring rod 277 may be used to detect the present of combustion, and is connected to controller 218, which directs gaseous fuel to be supplied to mixing chamber 240 so long as combustion is detected. Although mixing chamber 240 is most preferably oriented vertically when used with liquid fuels, it may be oriented in any position when used with gaseous fuel as effects of gravity on gaseous fuels is inconsequential.

Mixing assembly 240 and combustion chamber 247 may be used with gaseous fuel without flame tube 48 or ignitor rod 85. However, neither of these elements inhibit or interfere with the performance of the furnace when used with gaseous fuel, and it is anticipated that they will be included to facilitate conversion of a furnace between the two types of fuel, and to minimize the number of parts kept in inventory. Within the modular furnace concept presented herein, there is no need to vary the internal components of the combustion assembly.

As shown, the furnace of the present invention may be used with either liquid fuels or gaseous fuels with only a minimal difference between the components used therein. As described above, furnace 10 uses substantially all the same components for either liquid or gaseous fuels, differing only in the fuel dispensing tube and nozzle, the fuel delivery system, the combustion sensor, and the controller logic. The flame tube and the ignition rod may optionally be omitted for operation on gaseous fuels.

The mixer head-combustion chamber arrangements of the present invention are easily interchangeable in typical pulse-type furnaces, with the liquid dispensing tube and nozzle being selected by the manufacturer according to the type of fuel the combustion assembly and furnace is being assembled to utilize and the heating input of the system desired. Thus, there is no need for a complete redesign of the furnace system regardless of the type of fuel and heat input requirements. During manufacture, or during installation in the field, the assembler or serviceman will select either the liquid fuel dispensing tube (e.g. 32) and liquid fuel nozzle (e.g. 45), or gas dispensing tube (e.g. 232) and gas fuel nozzle (e.g. 245). For the liquid fuel system, selection of the proper nozzle will determine the heating input of the system, along with proper control of air input (e.g. orifice control downstream of air flapper valve. For the gas system, heating input is similarly determined by control of the gaseous fuel flow through the orifices in its delivery system, and by proper control of air input through its various orifices along its delivery system (e.g. flapper spacing and/or by use of an orifice downstream of the air flapper valve).

The foregoing description of the preferred embodiment of the invention has been presented for purposes of illustration and description. It is not intended to be exhaustive or to limit the invention to the precise form disclosed. Modifications or variations are possible in light of the above teachings by one of ordinary skill in the art. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A furnace for heating ambient air, said furnace comprising:

(a) means for providing ambient air to be heated;

(b) a combustion assembly for combusting an air-fuel mixture;

(c) means for providing combustion air to said combustion assembly;

(d) means for providing fuel to said combustion assembly; and (e) said combustion assembly comprising:

(i) an internal cavity having a mixing chamber and a combustion chamber;

(ii) an outlet in communication with said internal cavity and adapted to exhaust gases which result from the combustion of said air-fuel mixture;

(iii) a flame tube disposed intermediate said mixing chamber and said combustion chamber, said flame tube having an exit;

(iv) the cross sectional area of said outlet being less than the cross sectional area of said combustion chamber adjacent said flame tube exit; and (v) means for igniting said air-fuel mixture within said mixing chamber.

2. The furnace of claim 1, wherein said means for providing fuel further comprises means for connecting a fuel dispensing tube in fluid communication with a source of fuel and positioning said tube to discharge fuel into said mixing chamber.

3. The furnace of claim 2, wherein said means for providing fuel comprises a fuel dispensing tube which includes a distal end, and a nozzle connected to said distal adapted to spray liquid fuel into said mixing chamber.

4. The furnace of claim 2, wherein said means for providing fuel comprises a fuel dispensing tube which includes a distal end, and a nozzle carried by said distal end adapted to discharge gaseous fuel into said mixing chamber.

5. The furnace of claim 3, further comprising an ignitor rod at least partially disposed in said combustion chamber, said ignitor rod being adapted to enhance the combustion of said air-fuel mixture.

6. The furnace of claim 3, wherein said nozzle is adapted to spray liquid fuel in a predetermined spray pattern.

7. The furnace of claim 6, wherein said mixing chamber includes at least one side wall, and wherein said predetermined spray pattern is adapted to minimize direct impingement of liquid fuel on said side wall.

8. The furnace of claim 1, wherein said means for providing combustion air comprises an air inlet tube, and wherein said means for providing fuel comprises a fuel supply tube at least partially disposed within said air inlet tube.

9. The furnace of claim 8, wherein said means for providing fuel comprises a fuel manifold detachably connected adjacent said air inlet tube.

10. The furnace of claim 2, wherein said connecting means comprises a fuel manifold detachably connected adjacent said mixing chamber.

11. The furnace of claim 1, further comprising an ignitor rod at least partially disposed in said combustion chamber, said ignitor rod being adapted to enhance the combustion of said air-fuel mixture.

12. A pulse combustion furnace comprising:

(a) means for providing ambient air to be heated;

(b) a combustion assembly for combusting an air-fuel mixture, said combustion assembly including an internal cavity having a mixing chamber and a combustion chamber, said mixing chamber including at least one side wall;

(c) an outlet communicating with said combustion chamber and adapted to exhaust the by-products of combustion;

(d) a flame tube disposed intermediate said mixing chamber and said combustion chamber, said flame tube having an exit;

(e) the cross sectional area of said outlet being less than the cross sectional area of said combustion chamber adjacent said flame tube exit;

(f) means for igniting said air-fuel mixture within said mixing chamber;

(g) means for providing combustion air to said combustion assembly; and (h) means for providing fuel to said combustion assembly, said means for providing fuel including means for connecting a fuel dispensing tube in fluid communication with a source of fuel and for positioning said tube to discharge fuel into said mixing chamber.

13. The furnace of claim 12, wherein said means for providing fuel comprises a fuel dispensing tube, and a nozzle carried by said fuel dispensing tube, said nozzle being adapted to discharge liquid fuel into said mixing chamber.

14. The furnace of claim 13, wherein said nozzle is adapted to discharge liquid fuel in a predetermined spray pattern.

15. The furnace of claim 14, where said spray pattern is adapted to minimize the direct impingement of sprayed fuel on said side walls.

16. The furnace of claim 12, further comprising an ignitor rod at least partially disposed in said combustion chamber, said ignition rod being adapted to enhance the combustion of said air-fuel mixture.

17. The furnace of claim 12, further comprising a fuel dispensing tube, and a nozzle for dispensing fuel within said combustion assembly, said nozzle being mounted on said fuel dispensing tube.

18. The furnace of claim 12, wherein said means for providing combustion air includes an air supply tube, and wherein said means for providing fuel includes a fuel supply tube at least partially disposed in said air supply tube.

19. The furnace of claim 18, wherein said means for providing fuel comprises a fuel manifold detachably connected adjacent said air supply tube.

20. The furnace of claim 12, wherein said connecting means comprises a fuel manifold detachably connected adjacent said mixing chamber.

21. A furnace for heating ambient air, said furnace capable of pulse combusting liquid fuel, comprising:

(a) means for providing ambient air to be heated;

(b) a combustion assembly for combusting an air-fuel mixture, said combustion assembly including an internal cavity having a mixing chamber and a combustion chamber;

(c) an outlet communicating with said combustion chamber and adapted to exhaust the by-products of combustion;

(d) a flame tube disposed intermediate said mixing chamber and said combustion chamber, said flame tube having an exit;

(e) the cross sectional area of said outlet being less than the cross sectional area of said combustion chamber adjacent said exit;

(f) means for igniting said air-fuel mixture within said mixing chamber;

(g) means for providing combustion air to said combustion chamber; and (h) means for providing fuel to said combustion assembly, said means for providing fuel including means for connecting a fuel dispensing tube in fluid communication with a source of liquid fuel and in a position to discharge liquid fuel into said mixing chamber.

22. The furnace of claim 21, wherein said means for providing fuel further comprises:

(a) a liquid fuel dispensing tube connected to said connecting means; and (b) a nozzle carried by said liquid fuel dispensing tube in a position to discharge fuel into said mixing chamber.

23. The furnace of claim 22, wherein said means for providing combustion air comprises an air inlet tube, and wherein said liquid fuel dispensing tube is at least partially disposed within said air inlet tube.

24. The furnace of claim 23, wherein said connecting means further comprises a fuel manifold detachably connected adjacent said air inlet tube.

25. The furnace of claim 21, further comprising an ignitor rod at least partially disposed in said combustion chamber, said ignitor rod being adapted to enhance the combustion of said air-fuel mixture.

26. A furnace capable of pulse combusting liquid or gaseous fuel, comprising:

(a) means for providing ambient air to be heated;

(b) a combustion assembly for combusting an air-fuel mixture, said combustion assembly including an internal cavity having a mixing chamber and a combustion chamber, said mixing chamber including at least one side wall;

(c) an outlet communicating with said combustion chamber and adapted to exhaust the by-products of combustion;

(d) a flame tube disposed intermediate said mixing chamber and said combustion chamber;

(e) an ignitor rod at least partially disposed in said combustion chamber to enhance the combustion of said air-fuel mixture;

(f) means for igniting said air-fuel mixture within said mixing chamber;

(g) means for providing combustion air to said combustion assembly; and (h) means for providing fuel to said combustion assembly, said means for providing fuel including means for interchangeably connecting a fuel dispensing tube in fluid communication with a source of fuel, said dispensing tube disposed in a position to discharge fuel into said mixing chamber.

* * * * *

UNITED STATES PATENT AND TRADEMARK OFFICE

CERTIFICATE OF CORRECTION

PATENT NO. : 4,995,376

DATED : February 26, 1991

INVENTOR(S) : Garry O. Hanson

It is certified that error appears in the above-identified patent and that said Letters Patent is hereby corrected as shown below:

Claim 3 - Column 13 - Line 27 - after "distal", insert --end--

Claim 15 - Column 14 - Line 28 - delete "where", and insert therefor --wherein--

Claim 16 - Column 14 - Line 33 - delete "ignition", and insert therefor --ignitor--

Signed and Sealed this

Fourth Day of August, 1992

*Attest:*

DOUGLAS B. COMER

*Attesting Officer*

*Acting Commissioner of Patents and Trademarks*